US011282618B2

(12) United States Patent
Yang et al.

(10) Patent No.: US 11,282,618 B2
(45) Date of Patent: Mar. 22, 2022

(54) HIGH-SPEED FLAT CABLE HAVING BETTER BENDING/FOLDING MEMORY AND MANUFACTURING METHOD THEREOF

(71) Applicant: Amphenol AssembleTech Co., Ltd, Fujian (CN)

(72) Inventors: Wen Chu Yang, Xiamen (CN); Zhi Ming Huang, Xiamen (CN); David Rosenboom, Houston, TX (US); Jesus Jaramillo, Houston, TX (US)

(73) Assignee: Amphenol AssembleTech (Xiamen) Co., Ltd, Fujian (CN)

( * ) Notice: Subject to any disclaimer, the term of this patent is extended or adjusted under 35 U.S.C. 154(b) by 268 days.

(21) Appl. No.: 16/349,565

(22) PCT Filed: Nov. 14, 2017

(86) PCT No.: PCT/US2017/061597
§ 371 (c)(1),
(2) Date: May 13, 2019

(87) PCT Pub. No.: WO2018/090031
PCT Pub. Date: May 17, 2018

(65) Prior Publication Data

US 2020/0185124 A1 Jun. 11, 2020

(30) Foreign Application Priority Data

Nov. 14, 2016 (CN) ..... 201610999750.3
Nov. 14, 2016 (CN) ..... 201621222288.8

(51) Int. Cl.
*H01B 7/08* (2006.01)
*H01B 3/44* (2006.01)
*H01B 11/20* (2006.01)

(52) U.S. Cl.
CPC ..... *H01B 7/0838* (2013.01); *H01B 3/445* (2013.01); *H01B 7/0861* (2013.01); *H01B 11/203* (2013.01)

(58) Field of Classification Search
None
See application file for complete search history.

(56) References Cited

U.S. PATENT DOCUMENTS 4,481,379 A 11/1984 Bolick, Jr. et al.
4,487,992 A * 12/1984 Tomita ..... H01B 11/203 174/115

(Continued)

FOREIGN PATENT DOCUMENTS

CN 2821805 Y 9/2006
CN 202615825 U 12/2012

(Continued)

OTHER PUBLICATIONS

International Search Report and Written Opinion for International Application No. PCT/US2017/061597 dated Feb. 6, 2018.

(Continued)

*Primary Examiner* — Timothy J. Dole
*Assistant Examiner* — Muhammed Azam
(74) *Attorney, Agent, or Firm* — Wolf, Greenfield & Sacks, P.C.

(57) ABSTRACT

A high-speed flat cable includes a plurality of shielded signal units, one or more bendable composite layers, and an adhesive layer. The shielded signal units are substantially coplanar, spaced apart from each other or adjoining each other. The one or more bendable composite layers includes an inner insulating film layer, a bendable aluminum foil layer, and an outer insulating film layer. The one or more bendable composite layers composed of the inner insulating film layer, the bendable aluminum foil layer, and the outer (Continued)

insulating film layer increase its mechanical bending/folding property to improve the bending/folding memory. The one or more bendable composite layers allows the flat cable to be bent with ease without rebounding, thereby enhancing production efficiency.

20 Claims, 9 Drawing Sheets

(56) References Cited

U.S. PATENT DOCUMENTS 4,533,784 A * 8/1985 Olyphant, Jr. ..... H01B 11/1016 174/36
4,649,228 A * 3/1987 Suzuki ..... H01B 7/0823 174/115
5,084,594 A * 1/1992 Cady ..... H01B 7/083 174/36
5,119,046 A * 6/1992 Kozlowski, Jr. ..... H01B 7/363 174/112
5,262,589 A * 11/1993 Kesler ..... H01B 7/0861 156/53
5,306,869 A * 4/1994 Springer ..... H01B 7/0861 156/53
5,872,334 A * 2/1999 Trazyik ..... H01B 11/203 174/36
6,444,902 B1 * 9/2002 Tsao ..... H01B 7/0861 174/113 R
6,531,658 B2 * 3/2003 Tanaka ..... H01B 7/0861 174/117 F
6,740,808 B1 * 5/2004 Chang ..... H01B 7/0861 174/113 R
6,781,061 B2 * 8/2004 Tanaka ..... H01B 7/0861 174/117 F
6,803,518 B2 * 10/2004 Chang ..... H01B 11/002 174/113 R
6,831,230 B2 * 12/2004 Ide ..... H01R 43/0207 174/84 R
6,977,344 B2 * 12/2005 Tanaka ..... H01B 7/0861 174/117 F
7,479,601 B1 * 1/2009 Cases ..... H01B 11/203 174/102 R
7,514,632 B2 * 4/2009 Lin ..... H01B 7/0823 174/117 F
7,601,917 B2 * 10/2009 Zamzow ..... H01B 7/0861 174/113 R
7,999,185 B2 * 8/2011 Cases ..... H01B 11/203 174/113 R
8,378,217 B2 * 2/2013 Sugiyama ..... H01B 11/203 174/113 R
8,466,365 B2 * 6/2013 Gundel ..... H04W 24/04 174/110 R
8,492,655 B2 * 7/2013 Gundel ..... H01B 11/002 174/117 F
8,658,899 B2 * 2/2014 Gundel ..... H01B 7/188 174/110 R
8,841,554 B2 * 9/2014 Gundel ..... H01B 7/0838 174/102 R
8,859,901 B2 * 10/2014 Gundel ..... H01B 7/0861 174/110 R
8,975,521 B2 * 3/2015 Huang ..... H01B 7/083 174/117 M
9,119,292 B2 * 8/2015 Gundel ..... H01B 9/02
9,159,470 B2 * 10/2015 Mutnury ..... H01B 3/00
9,355,755 B2 * 5/2016 Gundel ..... G02B 6/4416
9,362,023 B2 * 6/2016 Gundel ..... H01B 7/0861
9,520,209 B2 * 12/2016 Chiu ..... H01B 3/10
9,620,262 B1 * 4/2017 Saiz ..... H01B 7/0892
9,672,957 B2 * 6/2017 Kordecki ..... H01B 11/1891
9,704,615 B2 * 7/2017 Matsuda ..... H01B 3/004
10,147,515 B2 * 12/2018 Chin ..... H01B 7/04
10,424,420 B1 * 9/2019 Farkas ..... H01B 13/0036
10,424,421 B2 * 9/2019 Huang ..... H01B 11/002
10,643,766 B1 * 5/2020 Farkas ..... H01B 11/1834
2003/0141099 A1 * 7/2003 Tanaka ..... H01B 7/0869 174/117 F
2003/0141100 A1 * 7/2003 Tanaka ..... H01B 7/0807 174/117 F
2004/0026101 A1 * 2/2004 Ochi ..... H01B 11/002 174/36
2011/0247856 A1 * 10/2011 Matsuda ..... H01B 11/203 174/108
2013/0087361 A1 * 4/2013 Kaga ..... C08J 9/0061 174/102 R
2015/0083460 A1 3/2015 Gundel
2016/0233006 A1 * 8/2016 Chamberlain ..... H01B 7/40
2017/0301431 A1 * 10/2017 Li ..... H01B 11/02
2019/0371499 A1 * 12/2019 Huang ..... H01B 11/203
2020/0098490 A1 * 3/2020 Casher ..... H01B 7/0807
2020/0185124 A1 * 6/2020 Yang ..... H01B 7/0861

FOREIGN PATENT DOCUMENTS

JP 2009-277623 A 11/2009
WO WO 2010/148165 A2 12/2010
WO WO 2012/030362 A1 3/2012
WO WO 2012/030364 A1 3/2012
WO WO 2012/030365 A1 3/2012
WO WO 2012/030366 A1 3/2012
WO WO 2012/030367 A1 3/2012
WO WO 2012/138729 A1 10/2012
WO WO 2013/066407 A1 5/2013
WO WO 2014/074269 A1 5/2014
WO WO 2014/179106 A1 11/2014

OTHER PUBLICATIONS

International Preliminary Report on Patentability for International Application No. PCT/US2017/061597 dated May 23, 2019.

* cited by examiner

HIGH-SPEED FLAT CABLE HAVING BETTER BENDING/FOLDING MEMORY AND MANUFACTURING METHOD THEREOF

CROSS-REFERENCE TO RELATED APPLICATIONS

This application is a 35 U.S.C. § 371 National Phase filing of International Application No. PCT/US2017/061597, filed on Nov. 14, 2017, entitled "HIGH-SPEED FLAT CABLE HAVING BETTER BENDING/FOLDING MEMORY AND MANUFACTURING METHOD THEREOF," which claims priority to and the benefit of Chinese Patent Application No. 201610999750.3, filed on Nov. 14, 2016 and Chinese Patent Application No. 201621222288.8, filed on Nov. 14, 2016. The entire contents of these applications are incorporated herein by reference in their entirety.

FIELD OF THE DISCLOSURE

The present invention relates to a communication wire, and more particularly to a high-speed flat cable having a better bending/folding memory and a manufacturing method thereof.

BACKGROUND

High-speed data cables can be applied to electronic equipment, such as servers, workstations, switch ports, base stations, and so on. With the improvement in transmission rate and data storage capacity of the electronic equipment, the interior layout space of the electronic equipment becomes smaller and smaller, and the components are more compact. The existing high-speed flat cables are unable to meet the requirements. The existing high-speed flat cable structure consists of parallel conductors laminated with an upper covering and a lower covering. The upper covering and the lower covering uses Mylar. The bending/folding memory of this structure is not good and the flat cable is easy to rebound, so it is difficult to install the flat cable. The flat cable is thick and has a thickness of more than 1 mm.

SUMMARY OF THE DISCLOSURE

The existing flat cables are easy to rebound and thick, and not suitable for the internal structure of the electronic equipment which is small in size. To overcome the drawbacks of the existing flat cables, a high-speed flat cable having a better bending/folding memory is provided. The high-speed flat cable provides a better bending/folding memory by retaining a folded position for a particular period of time without rebounding.

According to an aspect of the present disclosure, a high-speed flat cable having a better bending/folding memory is provided. The high-speed flat cable comprises a plurality of shielded signal units, two bendable composite layers, and an adhesive layer. The shielded signal units are substantially arranged to be coplanar, spaced apart from each other or adjoining each other. The two bendable composite layers surround the plurality of shielded signal units. The two bendable composite layers each include an inner insulating film layer, a bendable aluminum foil layer, and an outer insulating film layer. The inner insulating film layer, the bendable aluminum foil layer, and the outer insulating film layer are adhered to each other by glue. The adhesive layer is located between the two bendable composite layers for the bendable composite layers at the periphery of the signal units to be adhered to each other.

In some embodiments, the two bendable composite layers have extension sections which transversely extend beyond the outmost signal units to be adhered to each other.

In some embodiments, the outer insulating film layer and the inner insulating film layer each have a width slightly greater than that of the bendable aluminum foil layer so as to block the bendable aluminum foil layer from being in contact with the outside.

In some embodiments, insulating varnish or insulating glue is provided at a position where the two bendable composite layers are adhered to each other so as to block the bendable aluminum foil layer from being in contact with the outside.

In some embodiments, the shielded signal units each include at least one core wire, a ground wire, and an aluminum foil Mylar wrap. The ground wire is disposed next to the core wire. The aluminum foil Mylar wrap is configured to wrap the core wire and the ground wire.

In some embodiments, the core wire includes at least one conductor and a longitudinal insulator. The longitudinal insulator is configured to surround the conductor. The number of the conductor may be one or more, and in some embodiments may be two.

In some embodiments, the number of the ground wire is one, disposed at one side of the core wire.

In some embodiments, the shielded signal units each include two ground wires. The two ground wires are symmetrically disposed at upper and lower sides or left and right sides of the core wire.

In some embodiments, the outer insulating film layer and the inner insulating film layer are made of PET (polyethylene terephthalate), PFA (polyfluoroalkoxy), FEP (fluorinated ethylene propylene), or other insulating materials able to enhance mechanical bending/folding memory.

According to another aspect of the present disclosure, a method to manufacture a high-speed flat cable having a better bending/folding memory is provided. The method comprises the steps of:

step 1: extruding a core wire, the core wire and a ground wire being arranged in parallel and wrapped with a shielding layer to form a shielded signal unit;

step 2: arranging a plurality of shielded signal units manufactured by the step 1 in parallel, an inner insulating film layer being coated with an adhesive layer, one side of the inner insulating film layer, having the adhesive layer, being against the shielded signal units, the inner insulating film layer being laminated on the parallel shielded signal units;

step 3: a bendable aluminum foil layer being bound and laminated on the inner insulating film layer by glue; and step 4: an outer insulating film layer being bound and laminated on the bendable aluminum foil layer by glue.

According to another aspect of the present disclosure, a high-speed flat cable having a better bending/folding memory is provided. The high-speed flat cable includes a plurality of shielded signal units, the shielded signal units being arranged to be substantially coplanar and adjacent each other, one or more insulative layers (e.g., an inner insulating layer) arranged on an upper side or a lower side of the plurality of shielded signal units, and a bendable metal foil layer adhered to the one or more insulative layers, wherein the bendable metal foil layer is insulated from the shielded signal units by the one or more insulative layers.

According to yet another aspect of the present disclosure, a method to manufacture a high-speed flat cable having a better bending/folding memory is provided. The method includes manufacturing a plurality of shielded signal units, wherein each of the plurality of shielded signal units comprise at least one core wire and at least one ground wire wrapped with a shielding layer, arranging the plurality of shielded signal units in parallel, arranging one or more insulative layers on an upper side and a lower side of the plurality of shielded signal units, and adhering a bendable metal foil layer to the one or more insulative layers, wherein the bendable metal foil layer is insulated from ground wires of the plurality of shielded signal units by the one or more insulative layers.

The bendable composite layers each composed of the inner insulating film layer, the bendable aluminum foil layer and the outer insulating film layer increase their mechanical bending/folding property to improve the bending/folding memory. The flat cable can be bent with ease and is not easy to rebound to solve the problem in assembly and to enhance the production efficiency.

DETAILED DESCRIPTION

In order to understand the present disclosure, embodiments of the present disclosure will now be described, by way of example only, with reference to the accompanying drawings.

Figure 1:
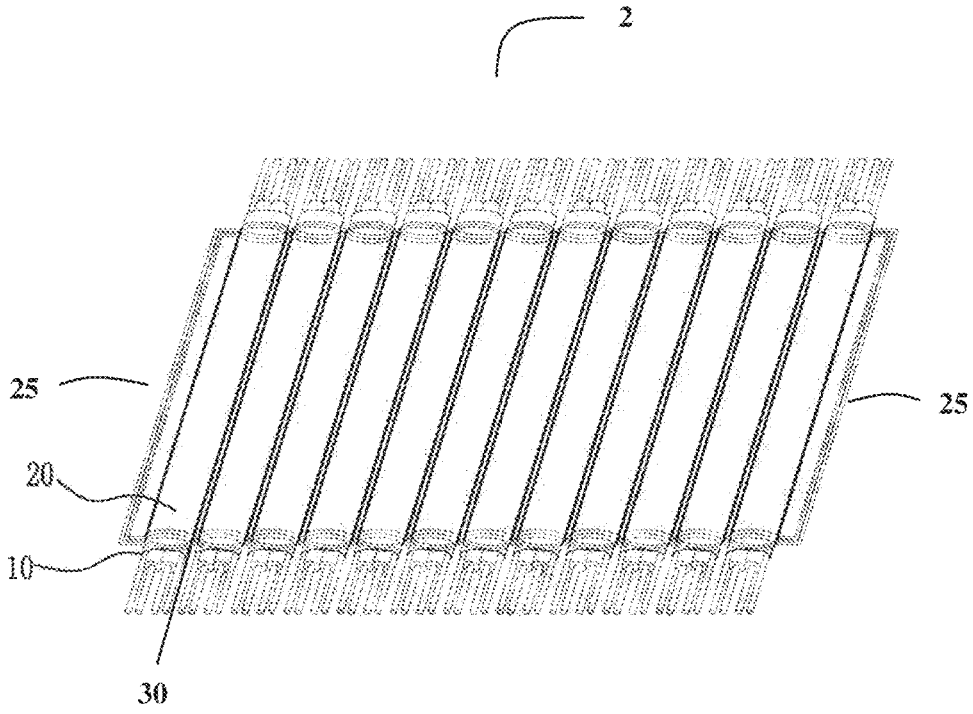
FIG. 1 is a structural schematic view of an embodiment of a flat cable with improved bending/folding memory.
Figure 2:
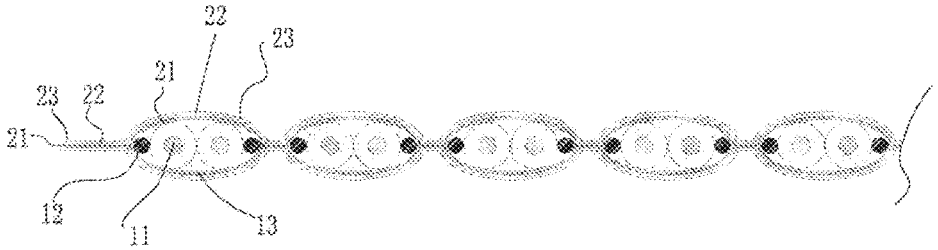
FIG. 2 is a cross-sectional view of the cable of FIG. 1, showing the signal units having an interval between every two of the signal units, according to some embodiments.

As shown in FIG. 1 and FIG. 2, a high-speed flat cable 2 having a better bending/folding memory comprises a plurality of signal units 10, two bendable composite layers 20, and an adhesive layer 30. The signal units 10 are substantially arranged to be coplanar and spaced apart from each other. The signal units 10 are spaced a determined distance apart from each other. The number of the signal units 10 may be changed and arranged according to the need or application. Each bendable composite layer 20 includes an inner insulating film layer 21, a bendable aluminum foil layer 22, and an outer insulating film layer 23. The outer insulating film layer 23 and the inner insulating film layer 21 are made of PET (polyethylene terephthalate), PFA (polyfluoroalkoxy), FEP (fluorinated ethylene propylene), or other insulating materials able to enhance their mechanical bending/folding memory. In some embodiments, the outer insulating film layer 23 and the inner insulating film layer 21 are PET films. In some embodiments, the outer insulating form layer 23 and the inner insulating film layer 21 may have a thickness in the range of 1 mil to 1.5 mil.

In some embodiments, the inner insulating film layer 21, the outer insulating film layer 23, and the bendable aluminum foil layer 22 are adhered to each other by glue. The two bendable composite layers 20 surround the plurality of signal units 10. The adhesive layer 30 is located between the two bendable composite layers 20 for the bendable composite layers 20 at the periphery of the signal units 10 to be adhered to each other. The interval between every two of the signal units 10 is a portion where the two bendable composite layers 20 are bound by the adhesive layer. The outer insulating film layer 23 and/or the inner insulating film layer 21 have a width slightly greater than that of the bendable aluminum foil layer 22 so as to block the bendable aluminum foil layer 22 from being in contact with the outside to prevent a short circuit. In some embodiments, the bendable composite layers 20 have extension sections 25 that transversely extend beyond the outmost signal units to be adhered to each other.

Each signal unit 10 is shielded, such as with a conductive wrap, shown as an aluminum foil wrap 13. As shown, aluminum foil wrap 13 may contact and be electrically connected to one or more ground wires 12. As shown, the bendable aluminum foil layers 22 are insulated from the ground wires 12 by one or more insulative layers, such as inner insulating film layer 21. As described herein, shielding of signals carried by each signal unit 10 is provided by the wrap 13, and the bendable aluminum foil layer 22 enhances mechanical bending/folding performance of the cable.

In some embodiments, the flat cable 2 provides a better bending/folding memory by retaining a folded position with very low relaxation. In some embodiments, the cable may maintain a bend angle, formed by folding the cable over itself, relaxing by no more than 5%, over a period of 1 hour. In other embodiments, the relaxation may be less over the same period of time such as between 1 and 5% or in other embodiments, the relaxation rate may be slightly more, such as between 5-8% or 8-10%. The initial bend angle, after a fold may be, for example 90 degrees or 180 degrees and the bend radius may be between 5 mm and 10 mm or, in some embodiments less, such as between 1 mm and 5 mm or in other embodiments, greater, such as between 10 mm and 20 mm.

In some embodiments, the inner insulation film 21, the outer insulation film 23, and the bendable aluminum foil layer 22 are thin, and the glue between them is also very thin. The overall flat cable has a thickness of less than 1 mm. The flat cable is provided with the bendable aluminum foil layer 22 having a better mechanical bending/folding performance to increase its bending/folding memory. The bendable aluminum foil layer 22 can be replaced with a copper foil which also has a better mechanical bending/folding performance.

In addition to the above-described embodiment to ensure that the bendable aluminum foil layer 22 is not in contact with the outside, the bendable aluminum foil layer 22 may be blocked from being in contact with the outside through insulating varnish or insulating glue provided at a position where the two bendable composite layers 20 are adhered to each other.

Figure 3:
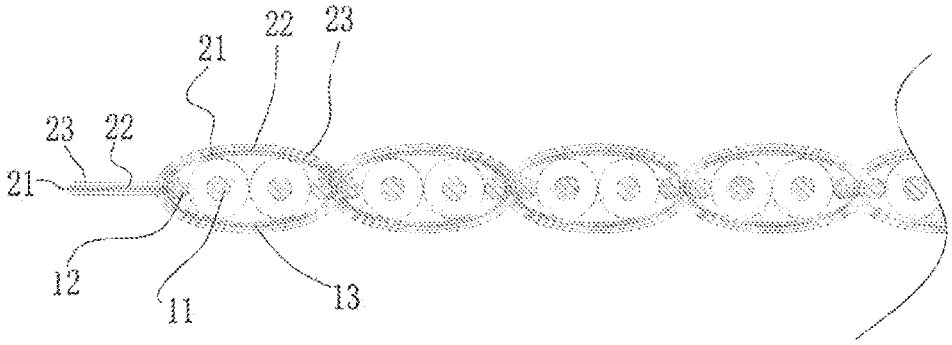
FIG. 3 is a cross-sectional view of an embodiment of the cable, showing the signal units not having an interval between every two of the signal units.
Figure 4:
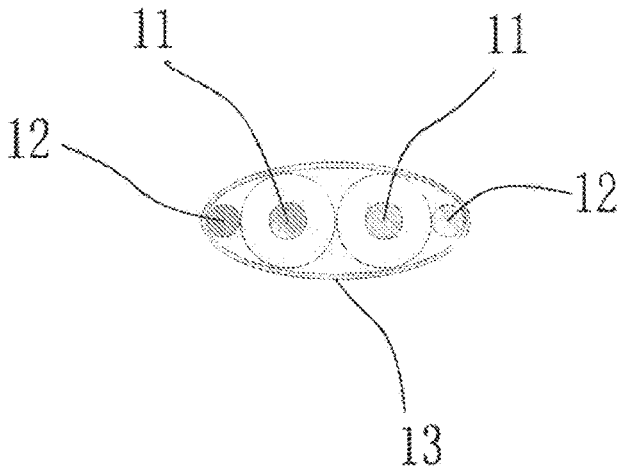
FIG. 4 is a schematic view of a first embodiment of a signal unit that may be incorporated into a cable with improved bending/folding memory as described herein.
Figure 5:
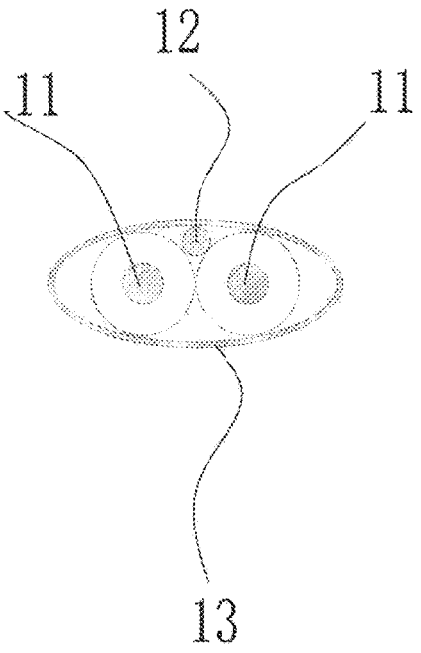
FIG. 5 is a schematic view of a second embodiment of a signal unit that may be incorporated into a cable with improved bending/folding memory as described herein.
Figure 6:
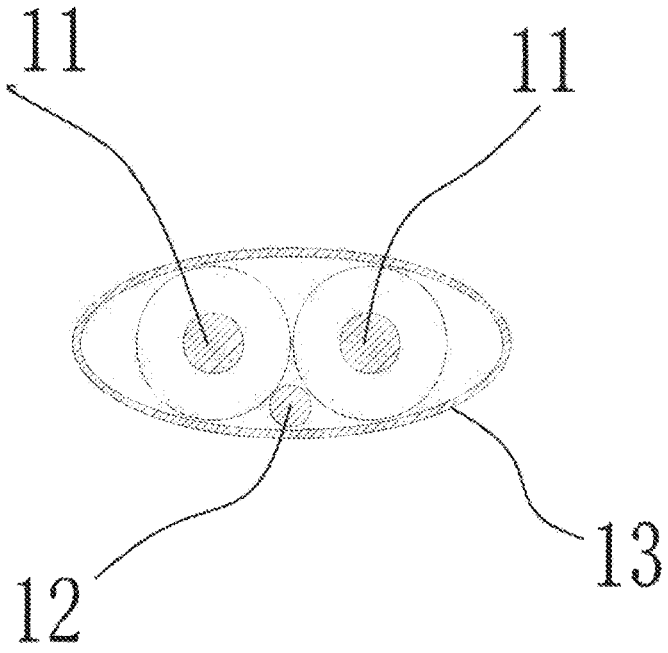
FIG. 6 is a schematic view of a third embodiment of a signal unit that may be incorporated into a cable with improved bending/folding memory as described herein.
Figure 7:
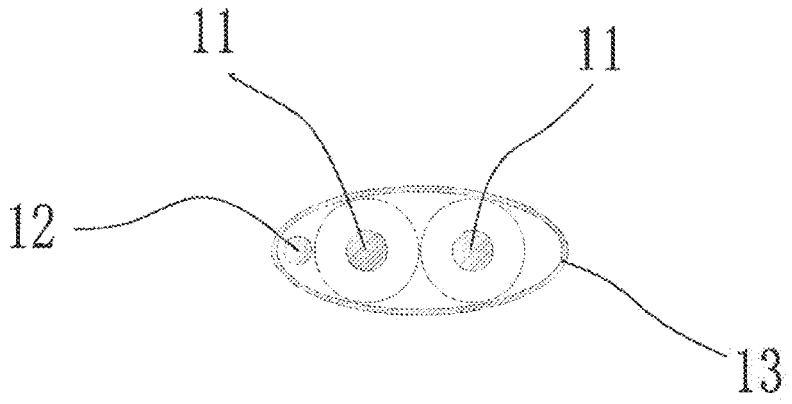
FIG. 7 is a schematic view of a fourth embodiment of a signal unit that may be incorporated into a cable with improved bending/folding memory as described herein.
Figure 8:
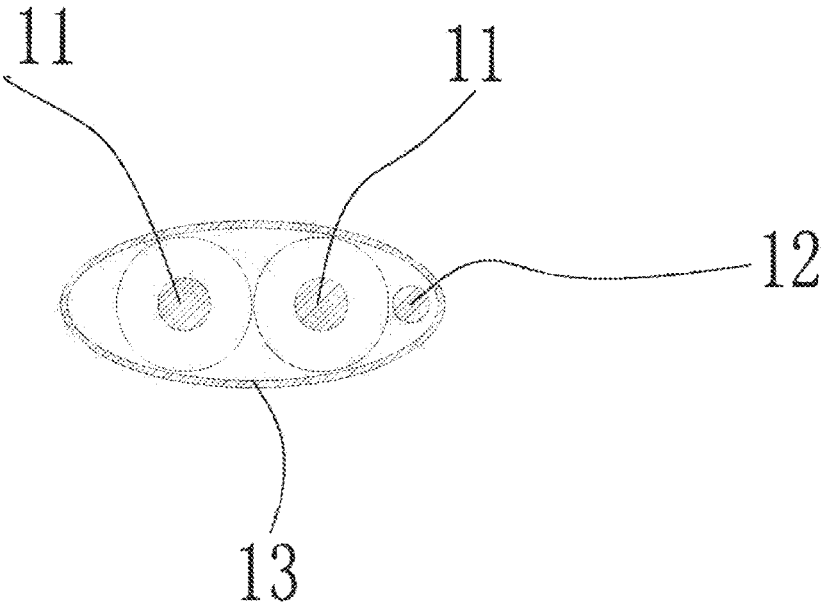
FIG. 8 is a schematic view of a fifth embodiment of a signal unit that may be incorporated into a cable with improved bending/folding memory as described herein.
Figure 9:
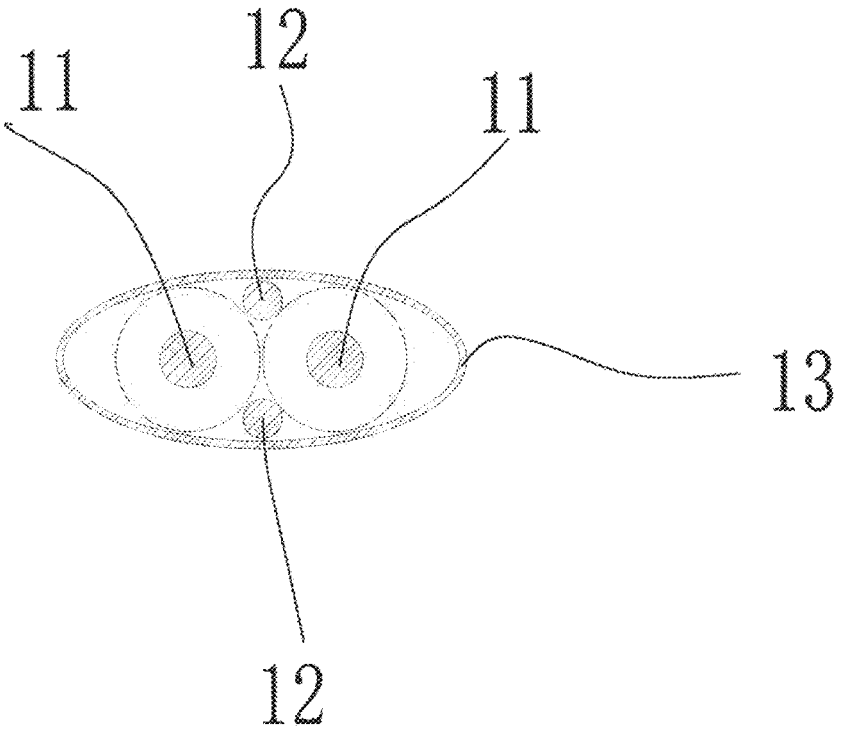
FIG. 9 is a schematic view of a sixth embodiment of a signal unit that may be incorporated into a cable with improved bending/folding memory as described herein.
Figure 10:
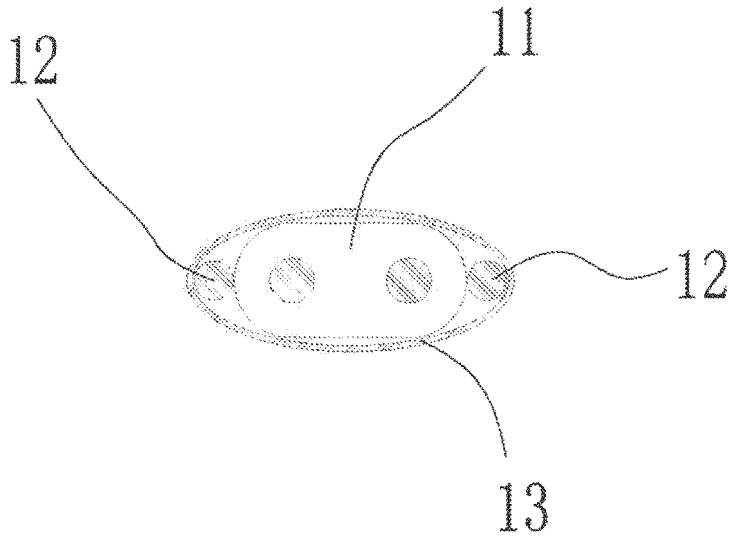
FIG. 10 is a schematic view of a seventh embodiment of a signal unit that may be incorporated into a cable with improved bending/folding memory as described herein.

In another embodiment, as shown in FIG. 3, the signal units 10 are arranged to adjoin each other. The two bendable composite layers 20 surround the plurality of signal units 10. The adhesive layer is located between the two bendable composite layers 20 for the bendable composite layers 20 at the periphery of the signal units 10 to be adhered to each other, without an interval between every two of the signal units 10. The bendable composite layers 20 between every two adjacent signal units 10 are not overlapped.

FIGS. 4 to 10 illustrate different embodiments of the signal units. Each signal unit 10 includes at least one core wire 11, at least one ground wire 12, and an aluminum foil Mylar wrap 13. At least one core wire 11 is provided in the signal unit 10. The core wire 11 includes a conductor and a longitudinal insulator. The longitudinal insulator is configured to surround the conductor. The conductor may be one or two. In some embodiments, the wire diameter of the core wire/conductor may be 31 AWG or less, such as between 31 and 40 AWG, However, in some embodiments, the wire diameter may be between 24 and 32 AWG The ground wire 12 is disposed next to the core wire 10. When the number of the ground wire 12 is one, the ground wire 12 is disposed at one side of the core wire 11, which may be at the left side, the right side, the upper side or the lower side of the single core wire 11, or at the left side, the right side, the upper side or the lower side of the two core wires 11. When the number of the ground wires 12 is two, the two ground wires 12 may be symmetrically disposed at the upper and lower sides or the left and right sides of the core wire 11. In some embodiments, the wire diameter of the ground wire may be 32 AWG or less, such as between 32 and 44 AWG. The aluminum foil Mylar wrap 13 is configured to wrap the core wire 11 and the ground wire 12. All these seven forms of signal units 10 are shielded with the wrap 13 and can be applied to the embodiments as shown in FIG. 2 and FIG. 3.

In some embodiments, a method to manufacture a high-speed flat cable having a better bending/folding memory comprises the following steps of:

step 1: extruding at least one core wire 11, the core wire 11 and at least one ground wire 12 being arranged in parallel and wrapped with a shielding layer (e.g., aluminum foil wrap 13) to form a shielded signal unit 10;

step 2: arranging a plurality of shielded signal units manufactured by the step 1 in parallel, upper and lower sides of the shielded signal units being provided with an inner insulating film layer respectively, the inner insulating film layer 21 being coated with an adhesive layer, one side of the inner insulating film layer 21, having the adhesive layer, being against the shielded signal units 10, the inner insulating film layer 21 being laminated on the parallel shielded signal units 10;

step 3: a bendable aluminum foil layer 22 being bound and laminated on the inner insulating film layer 21 by glue;

step 4: an outer insulating film layer 23 being bound and laminated on the bendable aluminum foil layer 22 by glue.

In some embodiments, the upper and lower sides of the shielded signal units may be provided with an inner insulating film layer 21, as described in step 2. However, the bendable aluminum foil layer 22 and the outer insulating film layer 23 may be provided on only one of the upper or lower sides of the shielded signal units. Thus, in these embodiments, the high-speed flat cable may include a bendable composite layer (similar to the bendable composite layer 20) arranged on one side of the shielded signal units and an insulating film layer (similar to the inner insulating film layer 21) arranged on the other side of the shielded signal units, while still providing improved bending/folding memory. The insulating film layer can be made of PET (polyethylene terephthalate), PFA (polyfluoroalkoxy), FEP (fluorinated ethylene propylene), or other insulating materials able to enhance their mechanical bending/folding memory. Moreover, though embodiments are possible in which an insulating layer is created by positioning a sheet of polymer between a bendable foil layer and the signal units, it is possible to create an insulation layer by individually insulating each of the signals units.

Although particular embodiments of the present invention have been described in detail for purposes of illustration, various modifications and enhancements may be made without departing from the spirit and scope of the present invention. For example, a bendable aluminum foil layer is described, a foil layer of other suitable material may alternatively be used. Moreover, a layer of similar mechanical properties (bendability and deformability so as to maintain a bent shape) may be used instead of or in addition to such a foil layer. Accordingly, the present invention is not to be limited except as by the appended claims.

In some embodiments, one or more of the following aspects may be provided, in any suitable combination.

1. A high-speed flat cable having a better bending/folding memory, comprising:

a plurality of shielded signal units, the shielded signal units being arranged to be substantially coplanar and adjacent each other; one or more insulative layers arranged on an upper side or a lower side of the plurality of shielded signal units; and a bendable metal foil layer adhered to the one or more insulative layers, wherein the bendable metal foil layer is insulated from the shielded signal units by the one or more insulative layers.

2. The high-speed flat cable of aspect 1, wherein the shielded signal units are arranged to be spaced apart or adjoining each other.

3. The high-speed flat cable of aspect 1, further comprising: at least one bendable composite layer, the at least one bendable composite layer comprising the one or more insulative layers and the bendable metal foil layer, wherein the one or more insulative layers comprises an inner insulating film layer and an outer insulating film layer, and wherein the bendable metal foil layer is arranged between the inner insulating film layer and the outer insulating film layer.

4. The high-speed flat cable of aspect 3, further comprising: two bendable composite layers, the two bendable composite layers each including the one or more insulative layers and the bendable metal foil layer, and an adhesive layer, the adhesive layer being located between the two bendable composite layers for the bendable composite layers at the periphery of the shielded signal units to be adhered to each other.

5. The high-speed flat cable of aspect 4, wherein the two bendable composite layers have extension sections which transversely extend beyond the outmost signal units to be adhered to each other.

6. The high-speed flat cable of aspect 1, wherein the one or more insulative layers each have a width slightly greater than that of the bendable metal foil layer so as to block the bendable metal foil layer from being in contact with the outside.

7. The high-speed flat cable of aspect 4, wherein insulating varnish or insulating glue is provided at a position where the two bendable composite layers are adhered to each other so as to block the bendable metal foil layer from being in contact with the outside.

8. The high-speed flat cable of aspect 1, wherein the shielded signal units each include at least one core wire, at least one ground wire, and a conductive wrap, wherein the at least one ground wire is disposed next to the core wire, and the conductive wrap is configured to wrap the core wire and the ground wire.

9. The high-speed flat cable of aspect 8, wherein the core wire includes at least one conductor and a longitudinal insulator, wherein the longitudinal insulator is configured to surround the conductor.

10. The high-speed flat cable of aspect 8, wherein the at least one ground wire comprises one ground wire disposed at one side of the core wire.

11. The high-speed flat cable of aspect 8, wherein the at least one ground wire comprises two ground wires that are symmetrically disposed at upper and lower sides or left and right sides of the core wire.

12. The high-speed flat cable of aspect 1, wherein the one or more insulative layers are made of PET (polyethylene terephthalate), PFA (polyfluoroalkoxy), or FEP (fluorinated ethylene propylene).

13. A method to manufacture a high-speed flat cable having a better bending/folding memory, the method comprising: manufacturing a plurality of shielded signal units, wherein each of the plurality of shielded signal units comprise at least one core wire and at least one ground wire wrapped with a shielding layer; arranging the plurality of shielded signal units in parallel; arranging one or more insulative layers on an upper side and a lower side of the plurality of shielded signal units; and adhering a bendable metal foil layer to the one or more insulative layers, wherein the bendable metal foil layer is insulated from the ground wires of the plurality of shielded signal units by the one or more insulative layers.

14. The method of aspect 13, wherein the shielding layer comprises a conductive wrap.

15. The method of aspect 13, further comprising: arranging the plurality of shielded signal units to be substantially coplanar and spaced apart from each other or adjoining each other.

16. The method of aspect 13, further comprising: arranging two bendable composite layers surrounding the shielded signal units, wherein the two bendable composite layers each include the one or more insulative layers and the bendable metal foil layer.

17. The method of aspect 16, further comprising: providing an adhesive layer between the two bendable composite layers for the bendable composite layers at the periphery of the shielded signal units to be adhered to each other.

18. The method of aspect 13, wherein the core wire includes at least one conductor and a longitudinal insulator, wherein the longitudinal insulator is configured to surround the conductor.

19. The method of aspect 13, wherein the at least one ground wire comprises one ground wire disposed at one side of the core wire.

20. The method of aspect 13, wherein the at least one ground wire comprises two ground wires that are symmetrically disposed at upper and lower sides or left and right sides of the core wire.

What is claimed is:

1. A high-speed flat cable comprising:

a plurality of shielded signal units, the plurality of shielded signal units being arranged to be substantially coplanar and adjacent to each other;

one or more insulative layers arranged on an upper side or a lower side of the plurality of shielded signal units; and a bendable metal foil layer adhered to the one or more insulative layers to provide the high-speed flat cable with bending/folding memory, wherein the bendable metal foil layer is insulated from the plurality of shielded signal units by the one or more insulative layers.

2. The high-speed flat cable of claim 1, wherein the plurality of shielded signal units are arranged to be spaced apart or adjoining each other.

3. The high-speed flat cable of claim 1, further comprising:

at least one bendable composite layer, the at least one bendable composite layer comprising the one or more insulative layers and the bendable metal foil layer, wherein the one or more insulative layers comprises an inner insulating film layer and an outer insulating film layer, and wherein the bendable metal foil layer is arranged between the inner insulating film layer and the outer insulating film layer.

4. The high-speed flat cable of claim 3, further comprising:

two bendable composite layers, the two bendable composite layers each including the one or more insulative layers and the bendable metal foil layer, and an adhesive layer, the adhesive layer being located between the two bendable composite layers for a portion of the two bendable composite layers at a periphery of the plurality of shielded signal units to be adhered to each other.

5. The high-speed flat cable of claim 4, wherein the two bendable composite layers have extension sections which transversely extend beyond outmost signal units to be adhered to each other.

6. The high-speed flat cable of claim 1, wherein the one or more insulative layers each have a width slightly greater than that of the bendable metal foil layer so as to block the bendable metal foil layer from being in contact with outside.

7. The high-speed flat cable of claim 4, wherein insulating varnish or insulating glue is provided at a position where the two bendable composite layers are adhered to each other so as to block the bendable metal foil layer from being in contact with outside.

8. A high-speed flat cable, comprising:

a plurality of shielded signal units, the plurality of shielded signal units being arranged to be substantially coplanar and adjacent to each other, each of the plurality of shielded signal units including at least one core wire, at least one ground wire, and a conductive wrap, wherein the at least one ground wire is disposed next to the core wire, and the conductive wrap is configured to wrap the at least one core wire and the ground wire;

one or more insulative layers arranged on an upper side or a lower side of the plurality of shielded signal units; and a bendable metal foil layer adhered to the one or more insulative layers, wherein the bendable metal foil layer is insulated by the one or more insulative layers from the plurality of shielded signal units including the respective conductive wraps.

9. The high-speed flat cable of claim 8, wherein each core wire of the at least one core wire includes a conductor and a longitudinal insulator, wherein the longitudinal insulator surrounds the conductor.

10. The high-speed flat cable of claim 8, wherein each of the plurality of shielded signal units includes at least one ground wire disposed next to the at least one core wire, wherein the at least one ground wire comprises one ground wire disposed at one side of the at least one core wire.

11. The high-speed flat cable of claim 10, wherein the at least one ground wire comprises two ground wires that are symmetrically disposed at upper and lower sides or left and right sides of the at least one core wire.

12. The high-speed flat cable of claim 1, wherein the one or more insulative layers are made of PET (polyethylene terephthalate), PFA (polyfluoroalkoxy), or FEP (fluorinated ethylene propylene).

13. A method to manufacture a high-speed flat cable having a better bending/folding memory, the method comprising:

manufacturing a plurality of shielded signal units, wherein each of the plurality of shielded signal units comprise at least one core wire and at least one ground wire wrapped with a shielding layer;

arranging the plurality of shielded signal units in parallel;

arranging one or more insulative layers on an upper side and a lower side of the plurality of shielded signal units; and adhering a bendable metal foil layer to the one or more insulative layers, wherein the bendable metal foil layer is insulated by the one or more insulative layers from the plurality of shielded signal units including the respective shielding layers.

14. The method of claim 13, wherein the shielding layer comprises a conductive wrap.

15. The method of claim 13, further comprising:

arranging the plurality of shielded signal units to be substantially coplanar and spaced apart from each other or adjoining each other.

16. The method of claim 13, further comprising:

arranging two bendable composite layers surrounding the plurality of shielded signal units, wherein the two bendable composite layers each include the one or more insulative layers and the bendable metal foil layer.

17. The method of claim 16, further comprising:

providing an adhesive layer between the two bendable composite layers for a portion of the two bendable composite layers at a periphery of the plurality of shielded signal units to be adhered to each other.

18. The method of claim 13, wherein each core wire of the at least one core wire includes a conductor and a longitudinal insulator, wherein the longitudinal insulator surrounds the conductor.

19. The method of claim 13, wherein the at least one ground wire comprises one ground wire disposed at one side of the at least one core wire.

20. The method of claim 13, wherein the at least one ground wire comprises two ground wires that are symmetrically disposed at upper and lower sides or left and right sides of the at least one core wire.

* * * * *